US010144601B2

(12) United States Patent
Masuda

(10) Patent No.: US 10,144,601 B2
(45) Date of Patent: Dec. 4, 2018

(54) SHEET FEEDING DEVICE AND SHEET FEEDING METHOD

(71) Applicant: Konica Minolta, Inc., Chiyoda-ku, Tokyo (JP)

(72) Inventor: Yoshiyuki Masuda, Kunitachi (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/684,980

(22) Filed: Aug. 24, 2017

(65) Prior Publication Data

US 2018/0065821 A1 Mar. 8, 2018

(30) Foreign Application Priority Data

Sep. 7, 2016 (JP) ..... 2016-174429

(51) Int. Cl.
*B65H 3/06* (2006.01)
*B65H 3/48* (2006.01)
(Continued)

(52) U.S. Cl.
CPC ..... *B65H 3/48* (2013.01); *B65H 3/0684* (2013.01); *B65H 3/128* (2013.01); *B65H 3/14* (2013.01); *B65H 3/5261* (2013.01); *B65H 5/062* (2013.01); *B65H 2404/14211* (2013.01); *B65H 2405/15* (2013.01); *B65H 2406/121* (2013.01);
(Continued)

(58) Field of Classification Search
CPC . B65H 3/14; B65H 3/48; B65H 5/228; B65H 2406/12; B65H 2406/121; B65H 2406/1211; B65H 2406/122; B65H 2406/1222; B65H 2515/212; B65H 2515/342; B65H 2601/21; B65H 2406/41; B65H 2406/412; B65H 2406/413; B65H 2406/414; B65H 2406/415;
(Continued)

(56) References Cited

U.S. PATENT DOCUMENTS 5,328,165 A * 7/1994 Martin ..... B65H 3/128 271/98
6,955,348 B2 * 10/2005 Koga ..... B65H 3/128 271/97
(Continued)

OTHER PUBLICATIONS

Hideaki Takahashi et al., "Development of Vacuum Feed Apparatus for Extensive Media Capabilities", Ricoh Technical Report No. 41, Feb. 2016, pp. 80-89.

*Primary Examiner* — Jeremy R Severson
(74) *Attorney, Agent, or Firm* — Buchanan Ingersoll & Rooney PC

(57) ABSTRACT

An aspect of the present invention includes: a sheet storage unit configured to store sheets; an air blowing unit configured to blow air; a duct configured as a flow passage to an air blowing outlet for blowing air sent from the air blowing unit toward the front end of an upper part of a sheet bundle stored in the sheet storage unit; a suction transport unit configured to suck a sheet floating from the sheet bundle upward and transport the sheet; a shutter member configured to block the flow passage in the duct; and an openable/closeable member configured to open an opening part of the duct, such that air staying in the duct by blocking the flow passage by the shutter member is discharged from the opening part.

11 Claims, 13 Drawing Sheets

(51) Int. Cl.

| | |
|---|---|
| ***B65H 3/14*** | (2006.01) |
| ***B65H 3/52*** | (2006.01) |
| ***B65H 5/06*** | (2006.01) |
| ***B65H 3/12*** | (2006.01) |

(52) U.S. Cl.
CPC .... *B65H 2406/14* (2013.01); *B65H 2406/415* (2013.01); *B65H 2513/41* (2013.01); *B65H 2801/06* (2013.01)

(58) Field of Classification Search
CPC ..... B65H 2406/416; B65H 2406/417; B65H 2406/418; B65H 2557/371
See application file for complete search history.

(56) References Cited

U.S. PATENT DOCUMENTS 8,210,518 B2 * 7/2012 Suzuki ..... B65H 3/128 271/97
8,444,138 B2 * 5/2013 Taki ..... B65H 3/128 271/105

* cited by examiner

SHEET FEEDING DEVICE AND SHEET FEEDING METHOD

CROSS-REFERENCE TO RELATED APPLICATIONS

Japanese Patent Application No. 2016-174429 filed on Sep. 7, 2016 including description, claims, drawings, and abstract the entire disclosure is incorporated herein by reference in its entirety.

BACKGROUND

Technological Field

The present invention relates to a sheet feeding device and a sheet feeding method, and particularly, to an air-suction sheet feeding type sheet feeding device having an air blowing mechanism and a sheet feeding method.

Description of the Related Art

Image forming apparatuses such as copy machines, printer devices, facsimile machines, printing machines, and multi-function apparatuses are equipped with sheet feeding devices for feeding sheets loaded in sheet storages one by one. As one of sheet feeding devices, there is an air-suction sheet feeding type sheet feeding device having an air blowing mechanism. This air-suction sheet feeding type sheet feeding device blows air toward an end face of an upper part of a bundle of loaded sheets, thereby floating sheets, and separates the floating sheets one by one, and transports each sheet by a suction belt (an air suction belt).

In this air-suction sheet feeding type, as a measure against a case where it is impossible to separate sheets by blowing air, there is a method of stopping blowing air such that sheets fall down due to their weights, thereby being separated. In a case of trying to stop a fan which is a source for supplying blowing air, it takes a lot of time for air to actually stop, and thus it is impossible to obtain a desired sheet feeding speed. For this reason, as a method of stopping blowing air, the following means has been proposed.

Non-Patent Literature 1 discloses a sheet feeding device for stopping blowing air by blocking a duct which is an air flow passage by a separating/floating shutter (a shutter valve).

[Non-Patent Literature 1] Hideaki TAKAHASHI et al, "Development of Vacuum Feed Apparatus for Extensive Media Capabilities", Ricoh Technical Report No. 41, Ricoh Technologies Co., Ltd., February 2016

However, in flow control using a fan, time loss occurs between flow indication and flow variation. Meanwhile, in order to cope with recent high-speed printing, in general, air-suction sheet feeding type sheet feeding devices continuously rotate air blowing fans. In these air-suction sheet feeding type sheet feeding devices, if a duct between a fan and a blowing nozzle is blocked as disclosed in Non-Patent Literature 1, since the duct is closed, the air pressure in the duct increases. Therefore, if the separating/floating shutter is opened to blow air toward sheets again, a volume of air larger than a desired volume of air is blown toward sheets, causing sheets to run violently (be deformed) or be blown away.

SUMMARY

The present invention was made in view of the above-described circumstances, and an object of the present invention is to provide a method capable of appropriately re-blowing air without causing sheets to nm violently (be deformed) or be blown away.

To achieve the above-mentioned object, according to an aspect, a sheet feeding device reflecting one aspect of the present invention comprises: a sheet storage unit configured to store sheets; an air blowing unit configured to blow air; a duct configured as a flow passage to an air blowing outlet for blowing air sent from the air blowing unit toward the front end of an upper part of a sheet bundle stored in the sheet storage unit; a suction transport unit configured to suck a sheet floating from the sheet bundle upward and transport the sheet; a shutter member configured to block the flow passage in the duct; and an openable/closeable member configured to open an opening part of the duct, such that air staying in the duct by blocking the flow passage by the shutter member is discharged from the opening part.

BRIEF DESCRIPTION OF THE DRAWING

The advantages and features provided by one or more embodiments of the invention will become more frilly understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

The following description will be made in the following order. Also, throughout the drawings, components having substantially the same functions or configurations are denoted by the same reference symbols, and repeated descriptions thereof will not be made.

1. First embodiment (an example in which doors are provided on a curved part of a duct)
2. Second embodiment (an example in which doors are disposed on a straight part of a duct)
3. Third embodiment (an example in which doors and a shutter are separate components)
4. Fourth embodiment (an example of a sliding door)
5. Fifth embodiment (an image forming apparatus having a sheet feeding device)
6. Others

1. First Embodiment

Overall Configuration of Sheet Feeding Device

Figure 1:
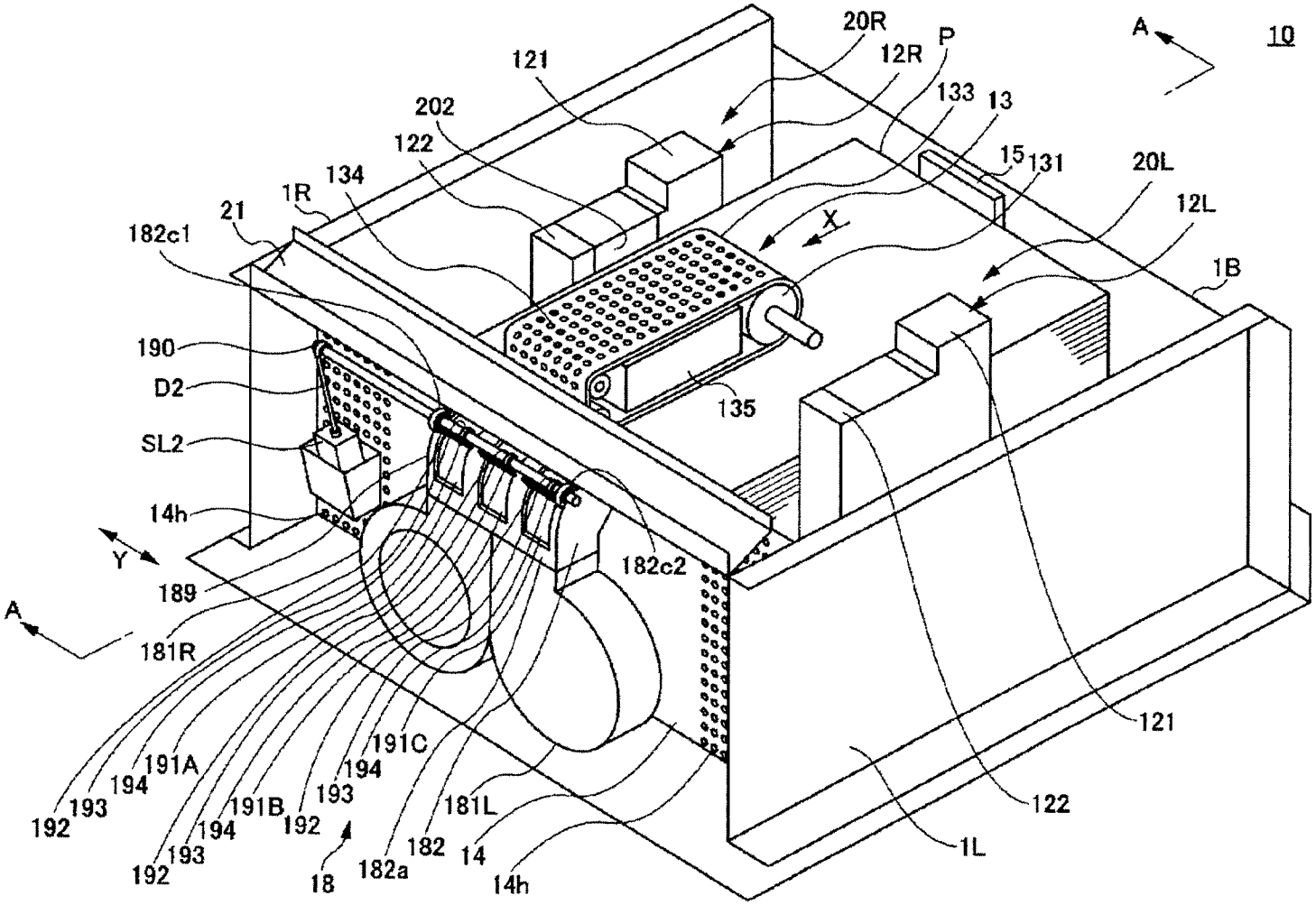
FIG. 1 is a perspective view illustrating an overview of a sheet feeding device according to a first embodiment of the present invention.
Figure 2:
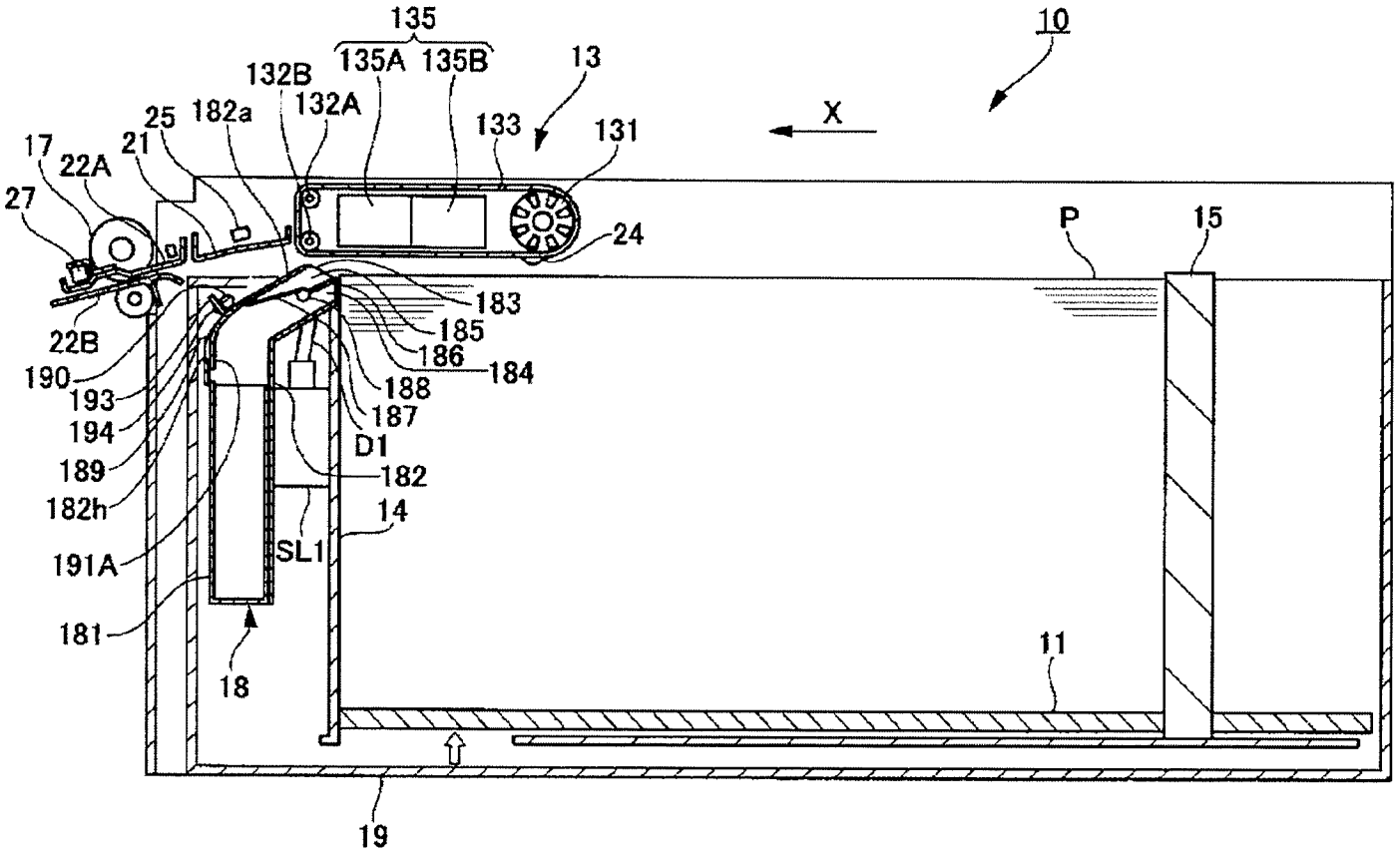
FIG. 2 is a schematic cross-sectional view taken along the sheet feeding direction of the sheet feeding device according to the first embodiment of the present invention.

An air-suction sheet feeding type sheet feeding device 10 will be described with reference to FIGS. 1 and 2. FIG. 1 is a perspective view illustrating a main part of a sheet feeding device according to a first embodiment. FIG. 2 is a schematic cross-sectional view taken along the sheet feeding direction of the sheet feeding device according to the first embodiment (a view as seen in a direction shown by arrows of a line A-A). However, in FIG. 2, some parts of FIG. 1 are not shown.

The sheet feeding device 10 according to the first embodiment has an air blowing mechanism configured to blow air toward an end face of sheets P loaded on a plate-like sheet feed tray 11 (an example of a sheet storage unit), and separates the sheets P one by one by blowing air, and feeds each sheet.

The sheet feeding device 10 includes the sheet feed tray 11 for loading sheets P, side wall parts 1L and 1R, a rear wall part 1B, and a plate-like front-end restricting member 14. The front-end restricting member 14 has a plurality of through-holes 14*h*.

The sheet feed tray 11 is configured such that it can be lifted (an arrow of FIG. 2) by a lifting mechanism (not shown in the drawings). In other words, sheets P are stored on the sheet feed tray 11 such that they can be lifted. On the sides of the sheets P loaded on the sheet feed tray 11, side restricting members 12L and 12R are disposed. The side restricting members 12L and 12R are provided so as to be movable in the width direction of the sheets P (the direction of an arrow "Y" of FIG. 1), and restrict the positions of both sides of the sheets P by gently pressing the sheets P loaded on the sheet feed tray 11 from both sides of the sheets P such that the interval therebetween becomes the sheet width of the sheets P.

The side restricting members 12L and 12R basically have the same configuration. Now, the configuration of the side restricting member 12L will be described in brief. The side restricting member 12L has a step at the top, such that a top surface 121 on the upstream side in the transport direction of the sheets P, that is, the sheet feeding direction (the direction of an arrow "X") is relatively higher than a top surface 122 on the downstream side.

On the top surface 121 of the upstream side, although not shown in the drawings, a supporting member for supporting the upper end of the side restricting member 12L is attached. The top surface 122 of the downstream side overlaps a suction transport unit 13 (to be described below) in the transport direction of the sheets P. Further, if the sheet feed tray 11 is pulled out in the Y direction from a sheet feeding device body 19, the top surface 122 of the downstream side can pass below the suction transport unit 13.

On the front end side in the transport direction (the X direction) of the sheets P loaded on the sheet feed tray 11, the front-end restricting member 14 is disposed, and on the rear end side, a rear-end restricting member 15 is disposed. The front-end restricting member 14 restricts the front end position of the sheets P in the transport direction. The rear-end restricting member 15 is movable in the transport direction of the sheets P, and restricts the rear end position of the sheets P in the transport direction by gently pressing the sheets P from the rear end side.

Figure 5:
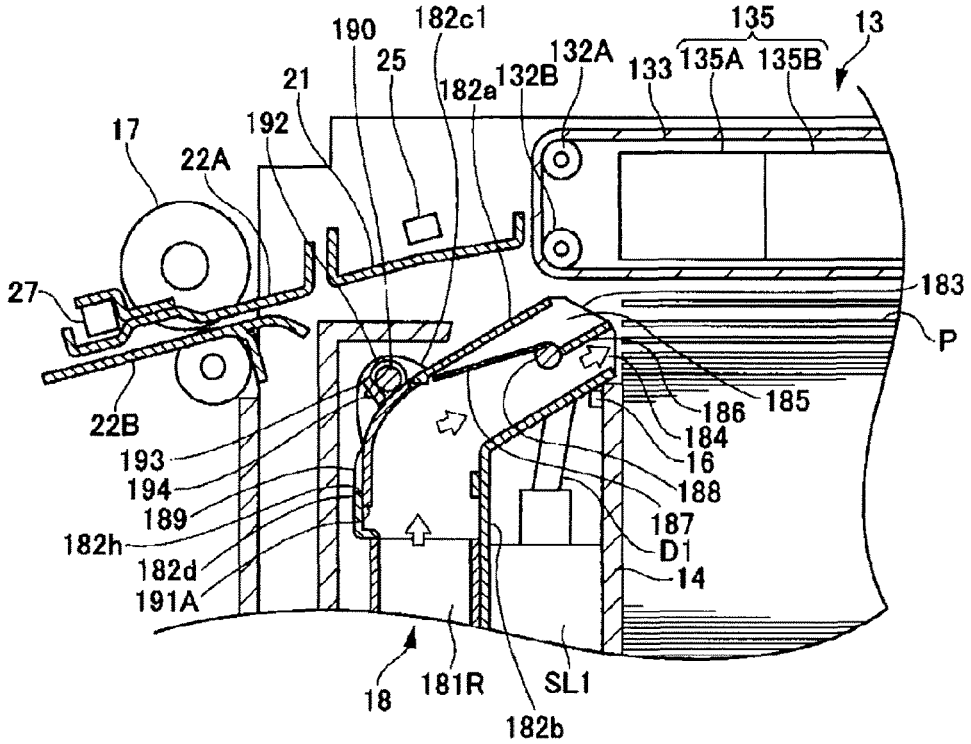
FIG. 5 is an enlarged cross-sectional view illustrating a main part of a duct of a front-end air blowing unit according to the first embodiment of the present invention (during floating of sheets).
Figure 6:
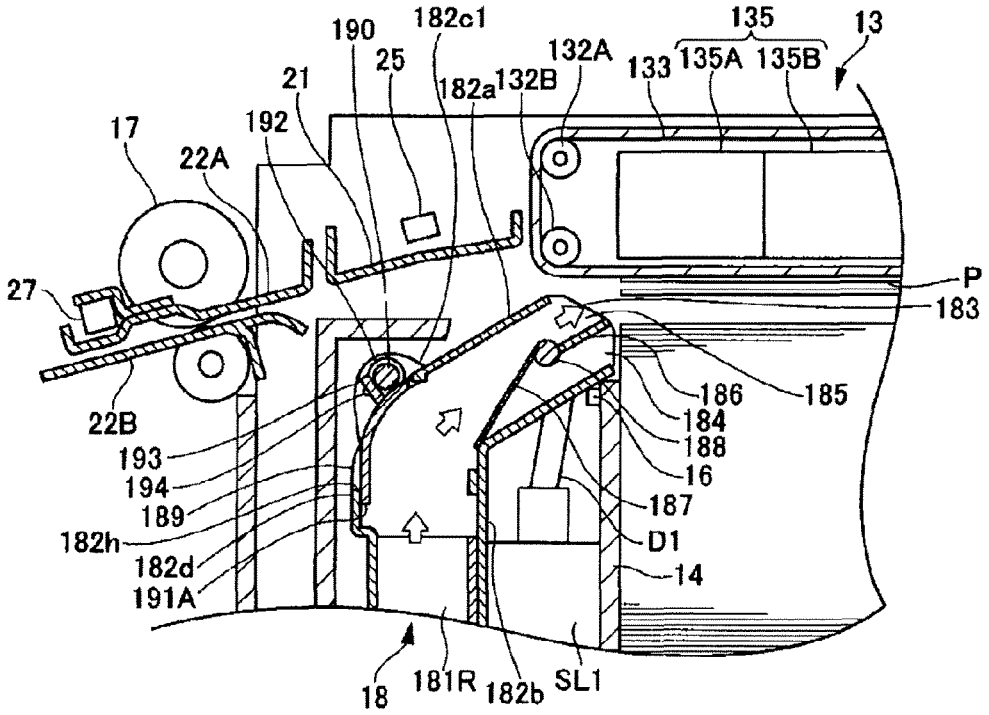
FIG. 6 is an enlarged cross-sectional view illustrating the main part of the duct of the front-end air blowing unit according to the first embodiment of the present invention (during separating of sheets).
Figure 7:
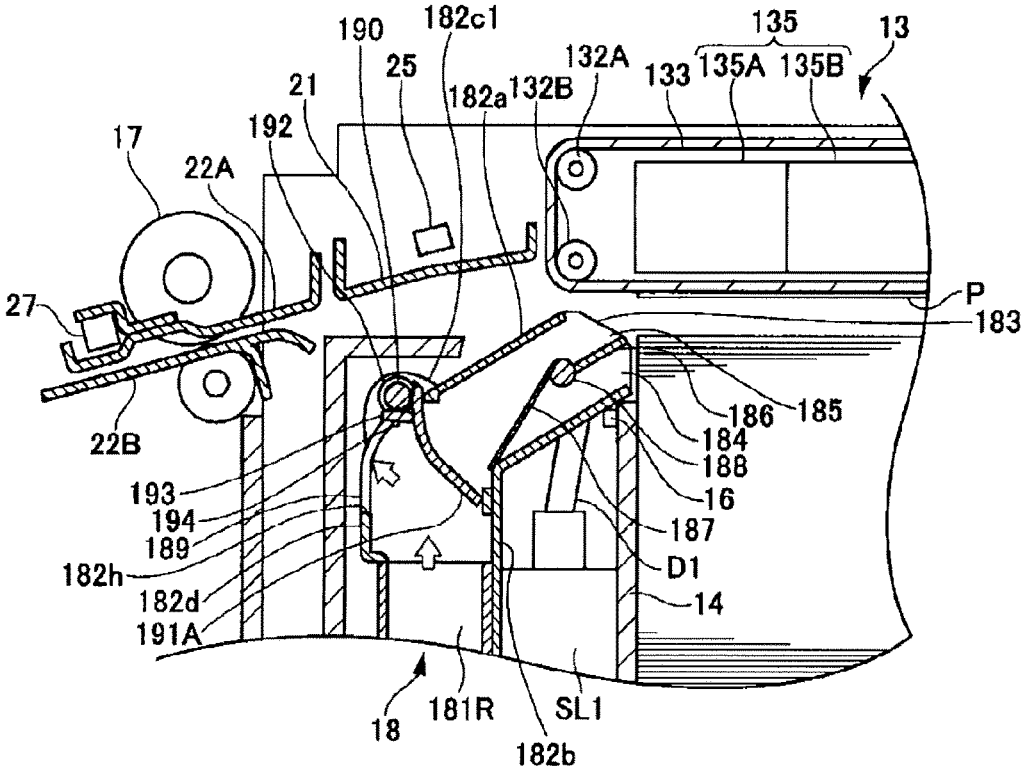
FIG. 7 is an enlarged cross-sectional view illustrating the main part of the duct of the front-end air blowing unit according to the first embodiment of the present invention (during cut-off of air).

Also, as shown in FIG. 5 to FIG. 7 (to be described below), on the front-end restricting member 14, a height detection sensor 16 for detecting the height of the uppermost sheet P is disposed.

A control unit 30 (to be described below) (see FIG. 8) performs control to lift the sheet feed tray 11 while driving a lifting motor (not shown in the drawings), on the basis of the detection result of the height detection sensor 16. According to this configuration, the height of the bundle of sheets P loaded on the sheet feed tray 11 (hereinafter, referred to as the sheet bundle) can be maintained at the best height to blow air, thereby loosing the sheets P.

Above the front end parts of the sheets P in the transport direction (the X direction), the suction transport unit 13 is disposed. The suction transport unit 13 includes a large roller 131 connected to a driving source, two small rollers 132A and 132B installed at predetermined distances from the large roller 131, and a loop-shaped (endless) suction belt 133 wound around the large roller 131 and the small rollers 132A and 132B so as to be rotatable.

The suction belt 133 has a number of small-diameter through-holes 134. On the inner side of the loop-shaped suction belt 133, a suction device 135 is disposed. The suction device 135 sucks each sheet P from above through the through-holes 134 formed in the suction belt 133. In other words, the suction transport unit 13 is configured to transport each sheet P by the suction belt 133 to transport rollers 17 (FIG. 2) composed of a pair of rollers while sucking the corresponding sheet P onto the suction belt 133 by the suction device 135.

The suction device 135 has two suction ducts 135A and 135B separated along the transport direction of the sheets P (the X direction). The suction device 135 is configured to be switchable between a case of sucking each sheet P only by the suction duct 135A and a case of sucking each sheet P by both of the suction ducts 135A and 135B.

In the vicinity of the downstream side in the transport direction of the sheets P loaded on the sheet feed tray 11, a front-end air blowing unit 18 (an example of an air blowing unit) is disposed. The front-end air blowing unit 18 is configured with air blowing fans 181, a duct 182, and so on, and is fixed to the sheet feeding device body 19. The sheet feeding device 10 includes an air blowing fan 181L and an air blowing fan 181R disposed on the left and right of the center of the width direction of the sheets P, as the air blowing fans 181. Hereinafter, in a case where the left and right air blowing fans 181L and 181R are collectively referred to as a generic term, or in a case where it is unnecessary to distinguish them, they are referred to as the air blowing fans 181.

If the air blowing fans 181 send air upward, the front-end air blowing unit 18 blows the air toward the end face of the front end part of the upper part of the loaded sheets P along the duct 182. Also, if the air blowing fans 181 send air, the front-end air blowing unit 18 blows the air toward the front end of each sheet P sucked by the suction transport unit 13.

Driving of the front-end air blowing unit 18 is controlled according to the size and grammage (stiffness) of the sheets P, the environment, and so on by the control unit 30 (to be described below). More specifically, under the control of the control unit 30, the volume of air to be blown from the air blowing fans 181 is controlled according to the size and grammage of the sheets P, the environment, and so on. The front-end air blowing unit 18 will be described below in detail.

Further, beside both sides of the sheets P loaded on the sheet feed tray 11, lateral air blowing units 20L and 20R are disposed. The lateral air blowing units 20L and 20R are installed in the side restricting members 12L and 12R. The lateral air blowing units 20L and 20R blow air from both sides in a direction perpendicular to the transport direction of the sheets P (X direction), toward the end faces of the upper part of the bundle of sheets P.

More specifically, the lateral air blowing unit 20R has an air blowing fan 201R (see FIG. 8), and an air outlet 202 (FIG. 1) for blowing air sent from the air blowing fan 201R toward the upper part of the sheets P. Similarly, the lateral air blowing unit 20L has an air blowing fan 201L (see FIG. 8) and an air outlet 202.

The air outlets 202 are disposed in the vicinities of the downstream side top surfaces 122 of the side restricting members 12L and 12R, so as to at least partially overlap the suction transport unit 13 in the transport direction of the sheets P. In other words, the leading-end-side parts of the air outlets 202 are positioned below the suction belt 133 as seen from a side.

As described above, the lateral air blowing units 20L and 20R are installed inside the side restricting members 12L and 12R. Therefore, even if different sizes of sheets P are loaded, it is possible to move the lateral air blowing units 20L and 20R at the same time by moving the side restricting members 12L and 12R. Also, in the present embodiment, the configuration in which the lateral air blowing units 20L and 20R are provided on both sides of sheets P is used; however, only on one side of sheets, any one of the lateral air blowing units 20L and 20R may be provided.

In the lateral air blowing units 20L and 20R, the air blowing fans 201L and 201R are driven, whereby air is blown from the air outlets 202 toward the lower part of the suction transport unit 13, and air is blown toward several sheets of the upper part of the loaded sheets P. Air is blown from the end of one side of the sheets P toward the end of the other side through the sheets. The sheets P are loosed by blowing air from the sides while blowing air from the front, and some sheets of the upper part are separated one by one. The suction transport unit 13 sucks only the uppermost sheet P from the separated sheets P.

Also, the air outlets of the lateral air blowing units 20L and 20R can be selectively blocked by openable/closeable blocking members 203 (not shown in the drawings). The control unit 30 (to be described below) controls opening and closing of the blocking members 203, thereby switching air blowing of the lateral air blowing units 20L and 20R between an ON state (blowing) and an OFF state (stop).

Blowing of air (air for floating the sides) from the air outlets 202 of the lateral air blowing units 20L and 20R is performed in sync with blowing of air from the front-end air blowing unit 18. However, blowing of air of the lateral air blowing units 20L and 20R may not be performed.

In FIG. 2, in the vicinity of the suction surface of the suction belt 133, a suction detection sensor 24 is disposed. The suction detection sensor 24 detects each sheet P sucked on the suction belt 133. In response to the detection result of the suction detection sensor 24, under the control of the control unit 30 (to be described below), the suction belt 133 starts rotating, thereby starting transporting the corresponding sheet P.

On the downstream side of the suction belt 133 in the transport direction, a first sheet transport guide member 21 is installed. The first sheet transport guide member 21 is formed in an upward convex shape, such that each sheet P loops.

On the downstream side of the first sheet transport guide member 21 in the sheet transport direction, a second sheet transport guide member 22A and a third sheet transport guide member 22B (FIG. 2) are installed. The second sheet transport guide member 22A and the third sheet transport guide member 22B are disposed so as to face each other in the vertical direction. A sheet P transported from the first sheet transport guide member 21 is guided to the nip part between the transport rollers 17 by the second sheet transport guide member 22A and the third sheet transport guide member 22B.

Also, in the vicinity of the downstream side of the suction belt 133 in the transport direction (on the first sheet transport guide member 21), a delivery sensor 25 is disposed. The delivery sensor 25 detects passage of a sheet P transported by the suction belt 133. If the suction belt 133 continuously rotates while sucking a sheet P, the front end of the sheet P enters the nip part between the transport rollers 17, and the sheet P is nipped by the transport rollers 17 and is delivered to a sheet feed destination.

Further, in the vicinity of the downstream side of the transport rollers 17 in the sheet transport direction (on the second sheet transport guide member 22A), a transport sensor 27 is installed. The transport sensor 27 detects passage of a sheet P transported by the transport rollers 17.

Front-End Air Blowing Unit

As described above, the front-end air blowing unit 18 is configured with the air blowing fans 181, the duct 182, and so on. The front-end air blowing unit 18 blows air sent from the air blowing fans 181, toward the front end part of the upper part of the sheet bundle loaded on the sheet feed tray 11 through the duct 182.

At the outlet of the duct 182, an air blowing part 183 (an example of an air blowing outlet) is formed. The air blowing part 183 is divided into a floating air blowing part 184 for floating the sheets P, and a separating air blowing part 185 for separating a sheet P sucked on the suction belt 133 from the underlying sheets P, by a partition 186.

Also, inside the duct 182, between the floating air blowing part 184 and the separating air blowing part 185, as an air switch mechanism, a rotating shaft 188 is installed so as to extend in the Y direction, and a first shutter plate 187 (a first switching member) is attached to the rotating shaft 188. If the rotating shaft 188 is driven by a driving shaft D1 of a first solenoid SL1 under the control of the control unit 30 (to be described below), the first shutter plate 187 switches an air blowing angle from the duct 182 (the air flow direction).

Further, the duct 182 has a curved part 189, and obliquely guides air sent in the vertical direction from the air blowing fans 181 disposed below the duct 182. As a result, the air sent from the air blowing fans 181 is blown obliquely downward to the vicinity of the front end of the upper part of the sheet bundle. The curved part 189 shown in FIGS. 1 and 2 have a relatively gentle curved (bent) shape; however, it may have a shape curved at a sharper angle.

On a part of an outer peripheral wall 182*a* of the duct 182 having the curved part 189, three doors 191A, 191B, and 191C (examples of an operable/closeable member) are installed in the sheet width direction (the Y direction) (FIG. 1). The individual doors 191A, 191B, and 191C are curved so as to correspond to the shape of the curved part 189. The doors 191A, 191B, and 191C form parts of the wall 182*a* of the duct 182 when they are closed.

The doors 191A, 191B, and 191C also function as a shutter member for blocking the flow passage of the inside of the duct 182 from the air blowing fans 181 to the air blowing part 183. However, one or more doors may be provided as long as the at least one door has a predetermined width or more with respect to the sheet width.

The upper parts of the individual doors 191A, 191B, and 191C have convex parts 192 (FIGS. 1 and 5), respectively. The convex parts 192 have through-holes extending in the Y direction. On the outer peripheral surfaces of the doors 191A, 191B, and 191C, protrusions 193 are provided along the Y direction. Hereinafter, in a case where the doors 191A, 191B, and 191C are collectively referred to as a generic term, or in a case where it is unnecessary to distinguish them, they are referred to as the doors 191. Also, the outer peripheral wall 182*a* having the curved part 189 is referred to as the outer wall.

Also, the upper part of the outer peripheral wall 182*a* of the duct 182 has convex parts 182*c*1 and 182*c*2 (see FIGS. 1 and 5) having through-holes extending in the Y direction. The convex parts 182*c*1 and 182*c*2 are provided at the left end and right end of the upper part of the duct 182.

A shaft 190 is inserted into the holes of the convex parts 182*c*1 and 182*c*2 of the duct 182 and the holes of the convex parts 192 of the doors 191A, 191B, and 191C. Further, the shaft 190 and the doors 191A, 191B, and 191C are fixed to the protrusions 193 vertical to the outer peripheral wall 182*a* of the duct 182 with screws 194. Further, one end side of the shaft 190 is connected to an end of a driving shaft D2 of a second solenoid SL2.

If the second solenoid SL2 drives the driving shaft D2 under the control of the control unit 30 (to be described below), the shaft 190 rotates. According to rotation of the shaft 190, the doors 191A, 191B, and 191C rotate on the shaft 190, whereby the doors 191A, 191B, and 191C are opened or closed. The doors 191 are configured such that the lower sides of the doors are rotatable on the shaft 190 disposed on the upper side. The doors 191 will also be referred to as movable walls constituting some parts of the duct 182. Also, the fixing means are not limited to the screws 194, and can be configured by other known technologies.

The doors 191A, 191B, and 191C of the present embodiment are biased in the closing direction by a torsion coil spring. Therefore, even if the driving source (the second solenoid SL2) is broken, it is possible to perform basic sheet feeding using air. Also, the door biasing mechanism is not limited to a torsion coil spring, and can be configured by other elastic members and other known technologies.

Door Biasing Means

Figure 3:
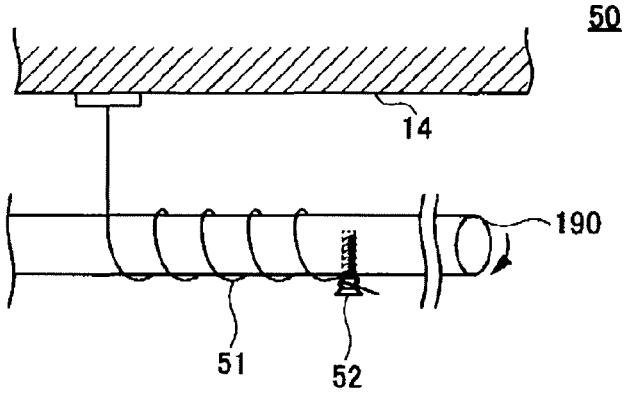
FIG. 3 is a schematic diagram illustrating a first example of a door biasing mechanism according to the first embodiment of the present invention.

FIG. 3 is a first example of the door biasing mechanism according to the first embodiment. FIG. 3 shows a state when the shaft 190 is seen from above.

In a door biasing mechanism 50, the shaft 190 is inserted into a torsion coil spring 51. One end of the torsion coil spring 51 is fixed directly or indirectly to the front-end restricting member 14, and the other end is fixed to the shaft 190 with screws 52 or the like. Alternatively, the other end of the torsion coil spring 51 may be fit in a hole formed in the circumferential surface of the shaft 190, thereby being fixed. One end of the torsion coil spring 51 may be fixed to the sheet feeding device body side, and the other end may be fixed to the shaft 190. In the door biasing mechanism 50, the shaft 190 is biased in a direction indicated by an arrow in FIG. 3, whereby the doors 191 are biased in the closing direction.

Figure 4:
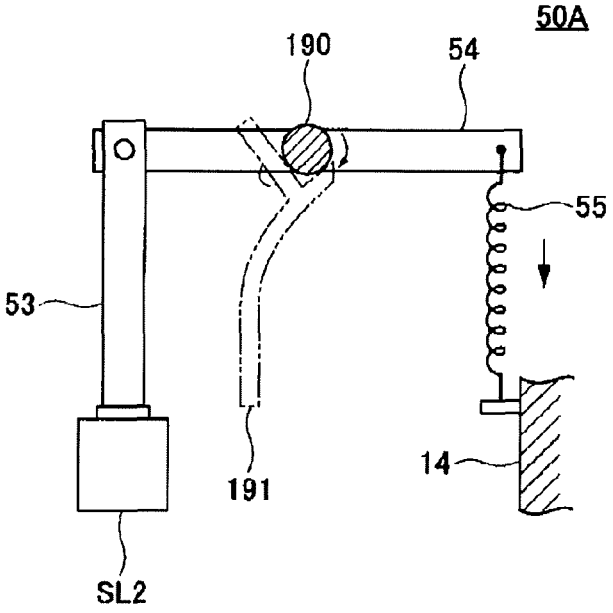
FIG. 4 is a schematic diagram illustrating a second example of the door biasing mechanism according to the first embodiment of the present invention.

FIG. 4 is a second example of the door biasing mechanism according to the first embodiment. FIG. 4 shows a state when the shaft 190 is seen from the axial direction.

In a door biasing mechanism 50A, one end (the left end in FIG. 4) of a rod-like member 54 fixed vertically to the shaft 190 is connected to a driving shaft 53 of a second solenoid SL2, and the other end (the right end in FIG. 4) is connected to one end of an extension spring 55. The other end of the extension spring 55 is fixed directly or indirectly to the front-end restricting member 14. In the door biasing mechanism 50A, the other end of the rod-like member 54 (closer to the front-end restricting member 14) is pulled downward by the extension spring 55, whereby the shaft 190, in other words, the doors 191 are biased in the closing direction.

As shown in FIG. 5 (to be described below), the lower side of an opening part 182*h* of the duct 182 has an engagement part 182*d*. If the doors 191 are biased in the closing direction by the door biasing mechanism as described above, the leading ends of the doors 191 come into contact with the inner side of the engagement part 182*d* and are sealed in a state where the doors 191 are closed.

State of Doors for Duct

The flow direction of air which is ejected from the duct 182 depends on the state of the first shutter plate 187 and the doors 191 included in an air switch mechanism. An operation of selectively switching the flow of air to be ejected from the duct 182 by the first shutter plate 187 and the doors 191 will be described in detail with reference to FIGS. 5 to 7.

Duct During Floating of Sheets

FIG. 5 is an enlarged cross-sectional view illustrating a main part of the duct 182 during floating of sheets.

In a case of floating sheets, the first shutter plate 187 is positioned at such an angle that it opens the floating air blowing part 184 and closes the separating air blowing part 185, and the three doors 191 are in the closed state. FIG. 5 shows the door 191A.

At this time, air blows from the floating air blowing part 184, whereby air (air for floating) is blown toward the end face of the front end side of the upper part of the sheet bundle, whereby a plurality of sheets P of the upper part of the sheet bundle floats. Then, the uppermost sheet P of the sheet bundle is sucked on the suction belt 133, and the second uppermost sheet is in the floating state. If a sheet P is sucked on the suction belt 133, whereby the sheet P comes into contact with the suction detection sensor 24, the suction detection sensor 24 is turned on.

Duct During Separating (Loosing) of Sheets)

FIG. 6 is an enlarged cross-sectional view illustrating the main part of the duct 182 during separating (loosing) of sheets.

In a case of separating the sheets, the air switch mechanism performs switching between the air blowing parts such that air enters between the uppermost sheet P sucked on the suction belt 133 and the second uppermost sheet (second sheet) P. Specifically, the first shutter plate 187 is positioned at such an angle that it closes the floating air blowing part 184 and opens the separating air blowing part 185, and the doors 191 are maintained in the closed state.

At this time, air blows from the separating air blowing part 185 and flows along the lower surface of the suction belt 133, whereby air (air for separating) is blown toward the front end of the sheet P sucked on the suction belt 133 and the vicinity thereof. Therefore, a gap is formed between the sheet P (first sheet) sucked on the suction belt 133 and the next sheet P (second sheet), so it becomes possible to separate the first sheet and the second sheet.

Duct During Cut-Off of Air

FIG. 7 is an enlarged cross-sectional view illustrating the main part of the duct 182 during cut-off of air.

In a case of cutting off air, the air switch mechanism opens the doors 191 of the outer peripheral wall 182*a* of the duct 182. Specifically, the leading ends of the doors 191 are brought into contact with a contact part of an inner circumferential side wall 182*b* (hereinafter, referred to as the inner circumferential wall) of the duct 182 having the curved part 189.

As a result, air from the air blowing fans 181 cannot flow toward the separating air blowing part 185. Therefore, sheets under the sheet sucked on the suction belt 133 fall down due to their weights, thereby being separated. At this time, air sent from the air blowing fans 181 hits the open doors 191, whereby the flow direction of the air changes to a direction toward the opening part 182*h*. Therefore, the air is discharged from the opening part 182*h*. As a result, air does not stay inside the duct 182. Therefore, the air pressure in the duct 182 does not increase.

In the present embodiment, the doors 191 are installed on the curved part 189 of the duct 182. In other words, the doors 191 (the opening part 182*h*) are disposed in the traveling direction of air which is sent from the air blowing fans 181. Therefore, it is possible to efficiently let air go out from the opening part 182*h* of the duct 182.

Also, it is not required to tightly seal the circumference of the front-end air blowing unit 18 in order to discharge air from the opening part 182*h* of the duct 182. Air discharged from the opening part 182*h* escapes to the outside along the guide of the upper side of the duct 182 and the through-holes 14*h* formed in the front-end restricting member 14.

The sheet feeding device 10 having the above-described configuration blows air from the front-end air blowing unit 18 and the lateral air blowing units 20L and 20R which are air blowing units, toward the end faces of the sheet S loaded on the sheet feed tray 11, such that the air enters between the sheets, thereby loosing the sheets P, and separates and feeds the sheets one by one. In this configuration, on the occasion of loosing the sheets P and separating the sheets one by one, as an example, it is possible to use the front-end air blowing unit 18 and the lateral air blowing units 20L and 20R as a main air blowing means and sub (auxiliary) air blowing means, respectively.

Control System of Sheet Feeding Device

Hereinafter, a control system of the sheet feeding device 10 will be described.

Figure 8:
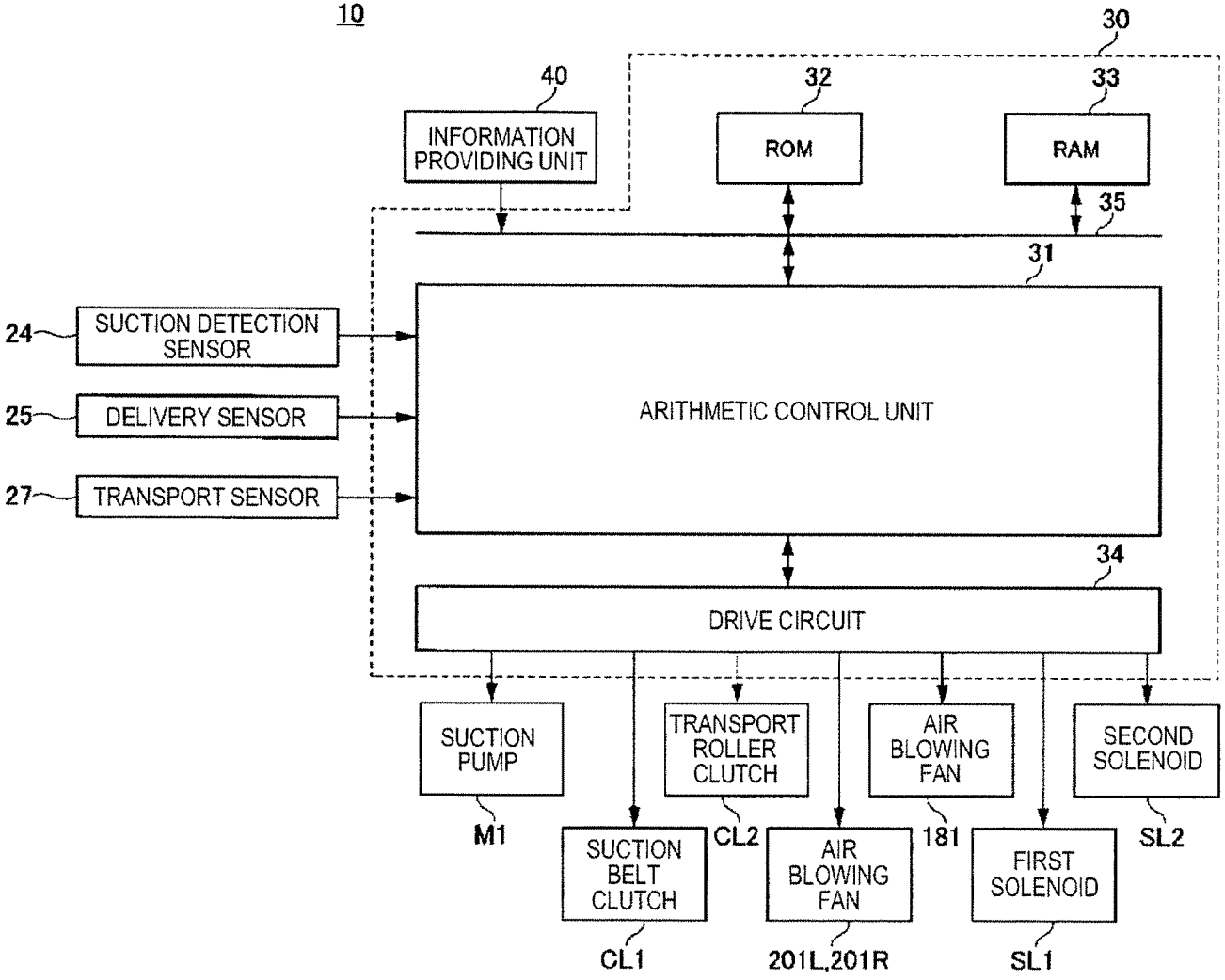
FIG. 8 is a block diagram illustrating an example of the configuration of a control system of the sheet feeding device according to the first embodiment of the present invention.

FIG. 8 is a block diagram illustrating an example of the configuration of the control system of the sheet feeding device 10.

The control unit 30 is configured, for example, with a microcomputer. The control unit 30 includes an arithmetic control unit 31 taking charge of control on an air switch operation of the duct 182, a ROM 32 retaining programs, and data to be used in the programs, and so on, a RAM 33 usable when the arithmetic control unit 31 performs arithmetic control, a drive circuit 34 configured to drive the motor, the solenoids, and the like on the basis of instructions (control signals) of the control unit 30, and a bus 35. However, the control unit 30 is not limited to a unit configured with a microcomputer, and can be configured with hardware.

To the control unit 30, sheet feed start information and information (data) on the size, grammage, and the like of sheets P are input from an information providing unit 40. Further, the type of sheets like "Plain Sheet" or "High-Quality Sheet" may be input. The information providing unit 40 is configured with sensors for automatically determining the size and grammage of sheets P, an operation unit which can be arbitrarily operated to designate information by a user.

The suction detection sensor 24, the delivery sensor 25, and the transport sensor 27 are connected to an input interface (not shown in the drawings) of the control unit 30.

The drive circuit 34 is a circuit configured to drive a suction pump M1 which is connected to the suction device 135, a suction belt clutch CL1, a transport roller clutch CL2, the air blowing fans 201L and 201R, the air blowing fans 181, the first solenoid SL1, and the second solenoid SL2.

The suction pump M1 vacuumizes the suction ducts 135A and 135B of the suction device 135 of the suction transport unit 13.

The suction belt clutch CL1 is a drive transmission switch means installed between the shaft of the large roller 131 and the driving shaft of a suction transport motor (not shown in the drawings). The suction belt clutch CL1 switches drive transmission from the driving shaft of the suction transport motor to the shaft of the large roller 131.

Similarly, the transport roller clutch CL2 is a drive transmission switch means installed between the shafts of the transport rollers 17 and the driving shaft of a transport roller drive motor (not shown in the drawings). The transport roller clutch CL2 switches drive transmission from the driving shaft of the transport roller drive motor to the shafts of the transport rollers 17.

A case of connecting the suction belt clutch CL1 and the transport roller clutch CL2 to the driving shafts of the motors, respectively, to perform drive transmission will be referred to as "turn-on", and the inverse case will be referred to as "turn-off". Turn-on control on the suction belt clutch CL1 and the transport roller clutch CL2 is instructed during print sheet interval control.

In the present embodiment, the air blowing fans 201L, 201R, and 181 always operate to continuously blow air. However, the air blowing fans 201L, 201R, and 181 may be switched between the ON state and the OFF state at predetermined timings.

The arithmetic control unit 31 performs control according to a control program on the basis of signals from the suction detection sensor 24, the delivery sensor 25, and the transport sensor 27. In other words, on the basis of the signals from those sensors, the arithmetic control unit 31 appropriately outputs a command (a control signal) for driving the suction transport motor (not shown in the drawings), the transport roller drive motor, the suction belt clutch CL1, and the transport roller clutch CL2, to the drive circuit 34, thereby transporting the sheets P one by one to the downstream side of the transport rollers 17 in the sheet transport direction.

Also, on the basis of information on the size and grammage of the sheets P provided from the information providing unit 40, the control unit 30 controls air switch timings of the air blowing mechanism of the front-end air blowing unit 18, and the volume of air to be blown from the front-end air blowing unit 18 and the lateral air blowing units 20L and 20R.

Air Switch Control

Now, air switch control according to the first embodiment will be described.

Figure 9:
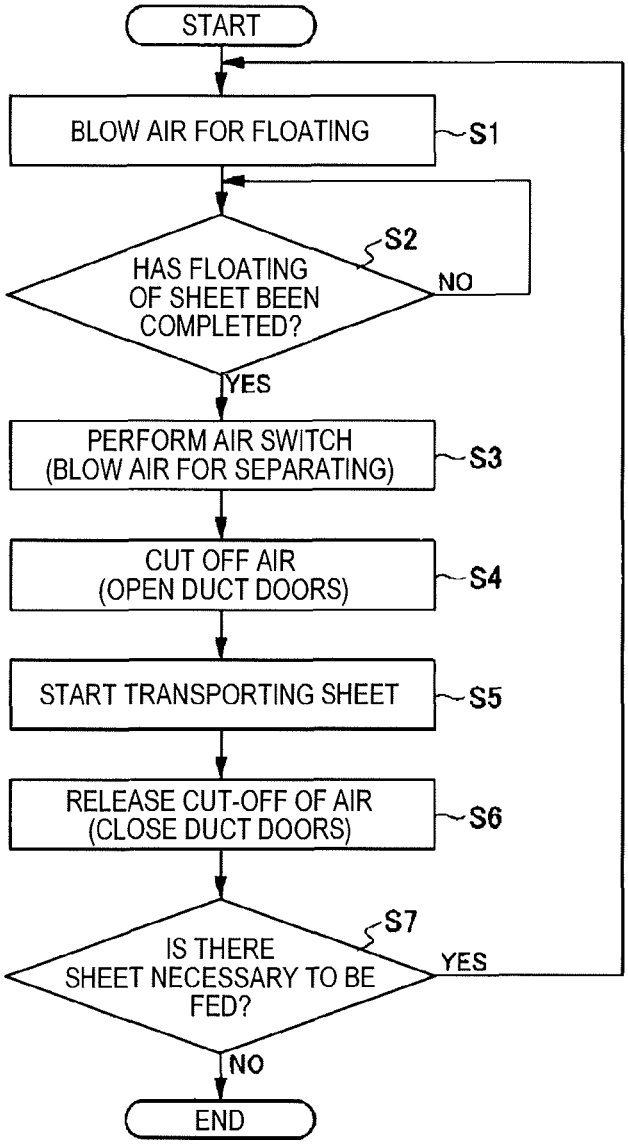
FIG. 9 is a flow chart illustrating air switch control according to the first embodiment of the present invention.

FIG. 9 is a flow chart illustrating air switch control (a sheet feeding method) according to the first embodiment. The arithmetic control unit 31 of the control unit 30' reads out programs from the ROM 32 and executes the programs, whereby the process shown in FIG. 9 is implemented.

As a premise, the suction transport motor, the transport roller drive motor, the air blowing fans 201L and 201R of the lateral air blowing units 20L and 20R, and the air blowing fans 181 of the front-end air blowing unit 18 operate in a period from sheet feeding start to sheet feeding end. Also, unlike the above description, air blowing from the air blowing fans 201L and 201R of the lateral air blowing units 20L and 20R may not be performed. Therefore, operation timings of the air blowing fans 201L and 201R will not be described.

If a sheet feeding process starts on the basis of a print job, first, the arithmetic control unit 31 controls driving of the first solenoid SL1 such the first shutter plate 187 is positioned at such an angle that it opens the floating air blowing part 184, and controls driving of the second solenoid SL2 such that the doors 191 are closed. In this way, in STEP S1, the arithmetic control unit 31 blows air for floating (FIG. 5) from the floating air blowing part 184 toward the front end face of the upper part of the sheet bundle.

Subsequently, in STEP S2, the arithmetic control unit 31 determines whether floating of a sheet P has been completed (a sheet P has been sucked on the suction belt 133), on the basis of the detection result of the suction detection sensor 24. In a case where floating of a sheet P has not been completed ("NO" in STEP S2), the arithmetic control unit keeps monitoring on floating of a sheet.

Meanwhile, in a case where floating of a sheet P has been completed ("YES" in STEP S2), at a predetermined timing, the arithmetic control unit 31 appropriately switches the first shutter plate 187 to such an angle that the separating air blowing part 185 is opened. Then, in STEP S3, the arithmetic control unit 31 blows air for separating (FIG. 6) between the uppermost sheet P sucked on the suction belt 133 and the second uppermost sheet (second sheet) P. As a result, the spare floating sheets are separated (loosed) from the sheet sucked on the suction belt 133.

Subsequently, at a predetermined timing, the arithmetic control unit 31 controls driving of the second solenoid SL2, thereby opening the doors 191 such that the opening part 182*h* is opened and the leading ends of the doors 191 come into contact with the inner circumferential wall 182*b* of the duct 182 (FIG. 7). Then, in STEP S4, the arithmetic control unit 31 cuts off air for separating sent from the air blowing fans 181 such that the air cannot flow toward the separating air blowing part 185. In this way, floating sheets which cannot be separated from the sheet sucked on the suction belt 133 even if air for separating is blown are separated.

Subsequently, in STEP S5, in the state where the sheet P is sucked on the suction belt 133, the arithmetic control unit 31 turns on the suction belt clutch CL1, thereby rotating the suction belt 133 to start transporting the sheet P sucked on the suction belt 133.

Cut-off of air for separating in STEP S4 and sheet transport start in STEP S5 may be performed at the same time or in reverse order.

Subsequently, in STEP S6, the arithmetic control unit 31 closes the doors 191, thereby closing the opening part 182*h* to release cut-off of air for separating.

Thereafter, if the front end of the sheet P reaches the delivery sensor 25, the delivery sensor 25 detects passage of the sheet P. Then, if a predetermined time elapses, the arithmetic control unit 31 turns off the suction belt clutch CL1. While the predetermined time elapses, the sheet P reaches the nip part of the transport rollers 17. After the suction belt clutch CL1 is turned off, if a predetermined time elapses, the arithmetic control unit 31 turns on the transport roller clutch CL2 such that the sheet P is transported by the transport rollers 17.

After the transport rollers 17 start transporting the sheet P, if the sheet P reaches the transport sensor 27, the transport sensor 27 detects passage of the sheet P. Therefore, the sheet P is transported to the downstream side of the transport rollers 17 in the sheet transport direction.

Subsequently, in STEP S7, the arithmetic control unit 31 determines whether there is a sheet necessary to be fed, on the basis of the print job. In a case where there is a sheet necessary to be fed ("YES" in STEP S7), the arithmetic control unit 31 proceeds to STEP S1, and switches the first shutter plate 187 such that the floating air blowing part 184 is opened and air for floating is blown.

On the occasion of feeding the second sheet, the arithmetic control unit turns on the suction detection sensor 24, and turns off the delivery sensor 25, such that it becomes possible to deliver the second sheet. Also, the arithmetic control unit turns on the suction belt clutch CL1 almost at the same time as turning on of the delivery sensor 25. Also, the arithmetic control unit turns off the transport roller clutch CL2 almost at the same time as turning off of the transport sensor 27.

In a case where there is no sheet necessary to be fed ("NO" in STEP S7), the arithmetic control unit 31 finishes the flow chart.

Effects of First Embodiment

According to the first embodiment configured as described above, after blowing of air to the sheets P is stopped by the first shutter plate 187 such that a sheet P is separated, air is removed from the duct 182 through the opening part 182*h* such that the pressure in the duct 182 decreases, and then air is blown again. Therefore, during re-blowing, a desired volume of air is obtained. Therefore, it is possible to appropriately re-blow air without causing sheets to run violently (be deformed) or be blown away.

More specifically, after air for separating is blown, the doors 191 are closed, whereby the air flow passage from the air blowing fans 181 to the air blowing parts 183 is blocked. Therefore, it is possible to surely separate a sheet to be delivered from a sheet just below it by the weight of the underlying sheet.

Also, since air does not stay inside the duct 182, the air pressure does not increase, and during floating of the next sheet, the sheets of the sheet bundle in the sheet feed tray do not run violently (are not deformed) or are not blown away, resulting in stability of sheet feeding.

Also, since the doors 191 (movable walls) are disposed in the air blowing direction from the air blowing fans 181, it is possible to efficiently let air go out from the duct 182. Therefore, it is not required to configure a shutter having complete sealing performance. Therefore, as compared to a case where sealing performance is highly required, it is easier to design the sheet feeding device 10.

2. Second Embodiment

A second embodiment is an example in which doors are installed on a straight part of a duct.

Figure 10:
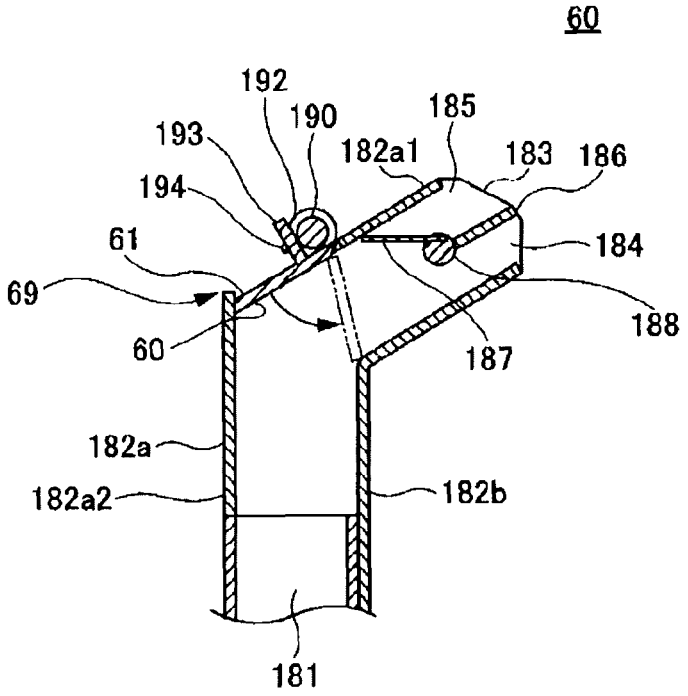
FIG. 10 is an enlarged cross-sectional view illustrating a main part of a duct of a front-end air blowing unit according to a second embodiment of the present invention.

FIG. 10 is an enlarged cross-sectional view illustrating a main part of a duct of a front-end air blowing unit according to the second embodiment. With reference to FIG. 10, differences from the duct 182 according to the first embodiment will be mainly described.

A duct 60 has a curved part 69 corresponding to the curved part 189 of the duct 182 according to the first embodiment. On the outer peripheral wall 182*a* (outer wall) of the duct 60 having the curved part 69, doors 61 are installed in the sheet width direction (the Y direction). Similarly in the first embodiment, the number of doors 61 needs only to be one or more. The outer peripheral wall 182*a* is composed of an upper wall 182*a*1 upper than the curved part 69 and a lower wall 182*a*2 lower than the curved part 69. The doors 61 are installed on the upper wall 182*a*1 of the outer peripheral wall 182*a* between the curved part 69 and the first shutter plate 187. According to rotation of the shaft 190, the doors 61 rotate on a shaft, whereby the doors 61 are opened or closed.

The doors 61 of the second embodiment are installed between the curved part 69 and the first shutter plate 187, that is, on the straight part of the upper wall 182*a* 1. Therefore, the doors 61 have a substantially straight cross-section shape, and the doors 61 (an opening part 60*h*) are disposed in the traveling direction of air which is sent from the air blowing fans 181. Therefore, similarly to the first embodiment, the second embodiment can efficiently let air go out from the opening part 60*h* of the duct 60.

Modifications

However, the doors 61 may be installed between the curved part 69 and the air blowing fans 181, that is, on the straight part of the lower wall 182*a*2. In this case, the length of the doors 61 in the air traveling direction (the vertical direction of FIG. 10) is set to be long, such that when the doors 61 are opened such that their leading ends come into contact with the inner circumferential wall 182*b* of the duct 60, the doors are diagonal to the air traveling direction as shown in FIG. 7. Therefore, air sent from the air blowing fans 181 hits the open doors 61 on the lower wall 182*a*2, whereby the flow direction of the air changes to a direction toward the opening part of the lower wall 182*a*2. Therefore, the air is discharged from the opening part.

3. Third Embodiment

In the first embodiment, a shutter member and an openable/closeable member are integrated such that the shutter member also serves as an openable/closeable member. However, in a third embodiment, a shutter member and an openable/closeable member are configured separately.

Main Part of Duct (Duct During Floating of Sheets)

Figure 11:
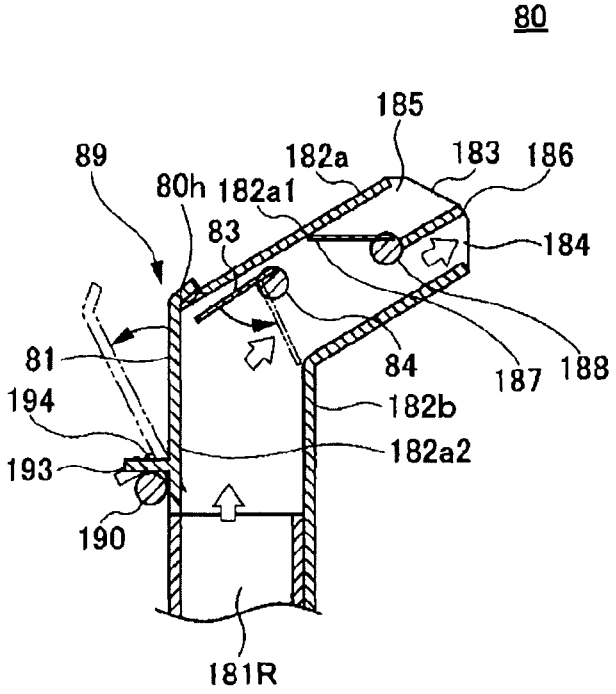
FIG. 11 is an enlarged cross-sectional view illustrating a main part of a duct of a front-end air blowing unit according to a third embodiment of the present invention (during floating of sheets).

FIG. 11 is an enlarged cross-sectional view illustrating a main part of a duct of a front-end air blowing unit according to the third embodiment of the present invention (during floating of sheets). With reference to FIG. 11, differences from the duct 182 according to the first embodiment will be mainly described.

Inside a duct 80, between a curved part 89 and the first shutter plate 187 (on the upper wall 182*a*1), a rotating shaft 84 and a second shutter plate 83 (an example of a shutter member) attached to the rotating shaft 84 are installed as the air switch mechanism.

The rotating shaft 84 is driven by a third solenoid SL3 (see FIG. 12) under the control of the control unit 30, whereby the second shutter plate 83 blocks or opens the air flow passage from the air blowing fans 181 toward the air blowing parts 183.

Also, on the lower wall 182*a*2 of the duct 80, doors 81 (an example of an openable/closeable member) is installed. The lower sides of the doors 81 close to the air blowing fans 181 are supported by the shaft 190 such that the doors are pivotable. Therefore, according to rotation of the shaft 190, the doors 81 rotate, thereby opening and closing an opening part 80*h*.

The duct 80 shown in FIG. 11 is in a state in which the first shutter plate 187 opens the floating air blowing part 184, and the second shutter plate 83 opens the air flow passage, and the doors 81 are closed. This state is a state in which air (air for floating) sent from the air blowing fans 181 is blown from the floating air blowing part 184 toward the front end of the upper part of the sheet bundle, and corresponds to the state of the duct 182 (FIG. 5) according to the first embodiment during floating of sheets.

Control System of Sheet Feeding Device

Figure 12:
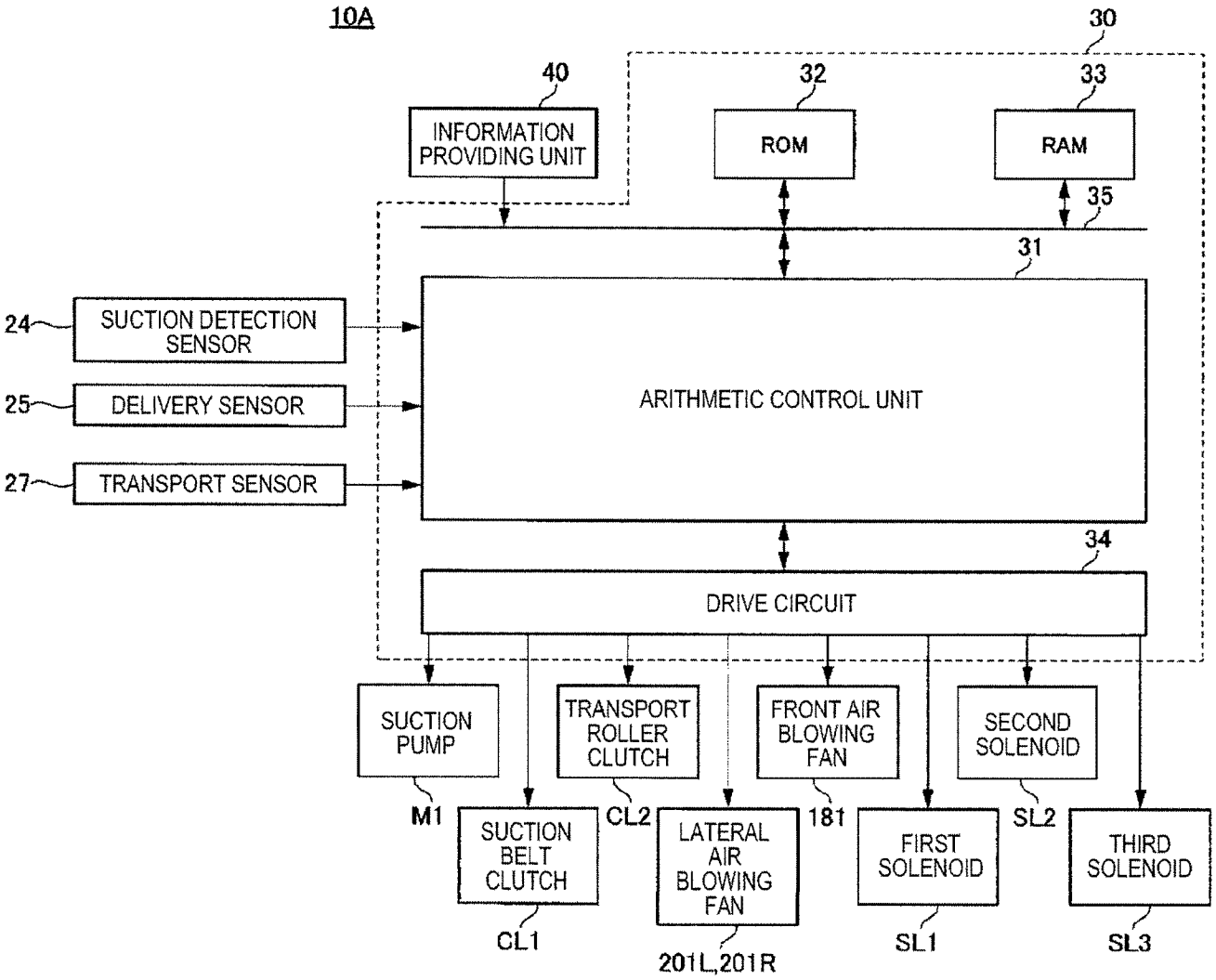
FIG. 12 is a block diagram illustrating an example of the configuration of a control system of the sheet feeding device according to the third embodiment of the present invention.

FIG. 12 is a block diagram illustrating an example of the configuration of a control system of a sheet feeding device according to the third embodiment.

A sheet feeding device 10A shown in FIG. 12 includes the third solenoid SL3 configured to open and close the second shutter plate 83. The second solenoid SL2 rotates the shaft 190 connected to the doors 81. The other configuration is the same as that of FIG. 8.

Air Switch Control

Now, air switch control according to the third embodiment will be described.

Figure 13:
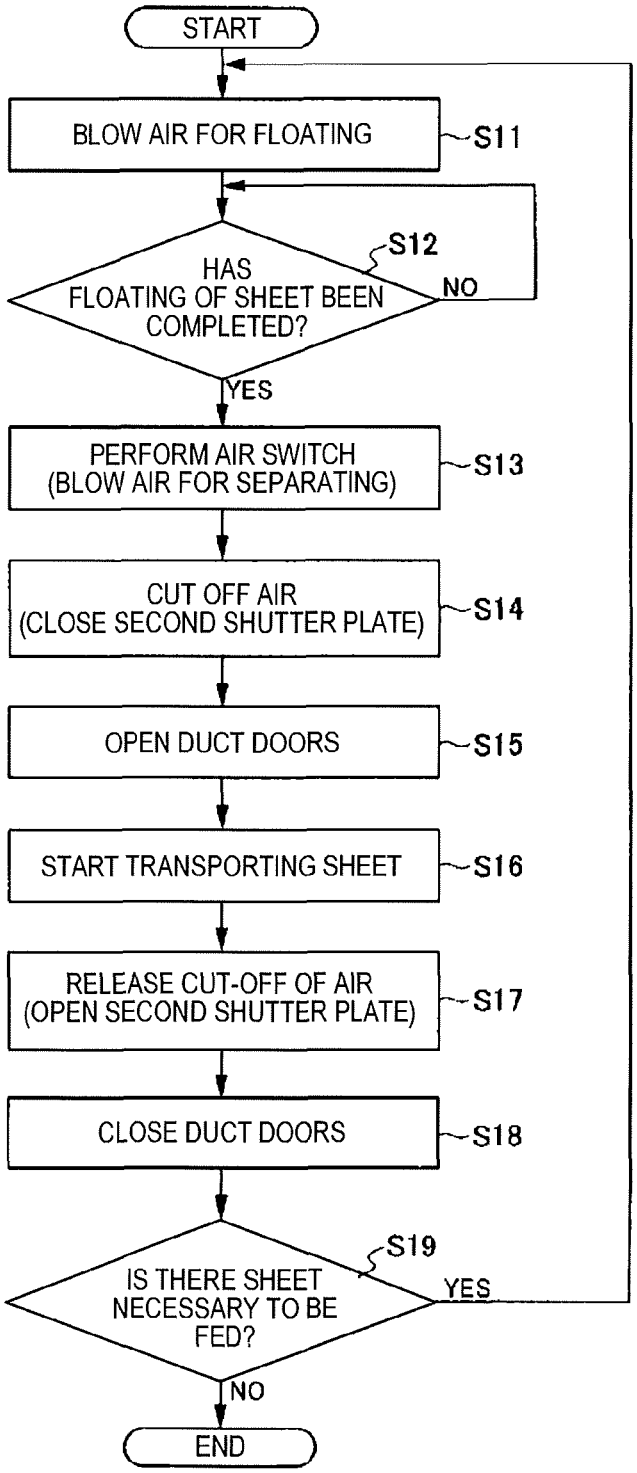
FIG. 13 is a flow chart illustrating air switch control according to the third embodiment of the present invention.

FIG. 13 is a flow chart illustrating air switch control (a sheet feeding method) according to the third embodiment. The arithmetic control unit 31 of the control unit 30 reads out programs from the ROM 32 and executes the programs, whereby the process shown in FIG. 13 is implemented.

STEPS S11 to S13 of FIG. 13 correspond to STEPS S1 to S3 of FIG. 9. Similarly, STEPS S14 and S15 of FIG. 13 correspond to STEP S4 of FIG. 9, and STEP S16 corresponds to STEP S5, and STEPS S17 and S18 correspond to STEP S6, and STEP S19 corresponds to STEP S7.

Figure 14:
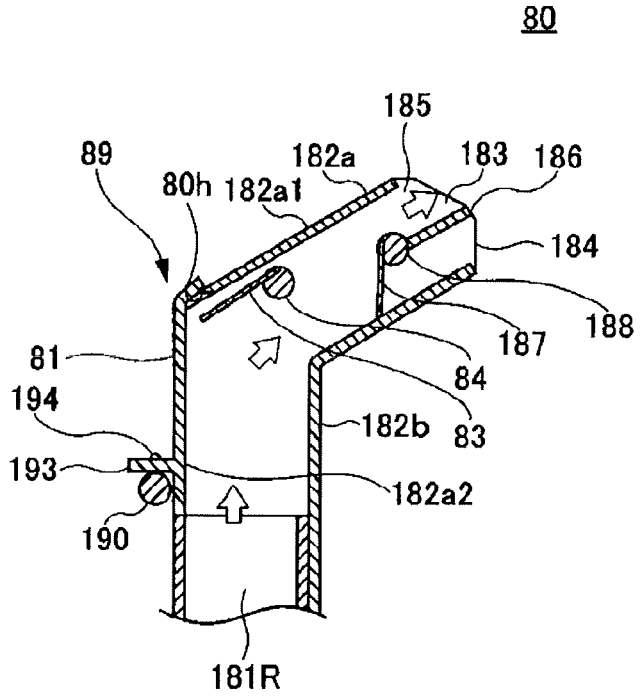
FIG. 14 is an enlarged cross-sectional view illustrating the main part of the duct of the front-end air blowing unit according to the third embodiment of the present invention (during separating of sheets).

If a sheet feeding process starts on the basis of a print job, first, the arithmetic control unit 31 blows air for floating in STEP S11 (FIG. 11), and determines whether floating of a sheet has been completed, in STEP S12, and performs air switch in STEP S13 (FIG. 14).

FIG. 14 is an enlarged cross-sectional view illustrating a main part of the duct 80 during separating of sheets.

The duct 80 shown in FIG. 14 is in a state in which the first shutter plate 187 opens the separating air blowing part 185 and the second shutter plate 83 opens the air flow passage and the doors 81 are closed. This state is a state in which air (air for separating) sent from the air blowing fans 181 is blown from the separating air blowing part 185 toward the front end of the upper part of the sheet bundle, and corresponds to the state of the duct 182 (FIG. 6) according to the first embodiment during separating of sheets.

Subsequently, in STEP S14, at a predetermined timing, the arithmetic control unit 31 controls driving of the third solenoid SL3 such that the air flow passage in the duct 80 is blocked by the second shutter plate 83.

Figure 15:
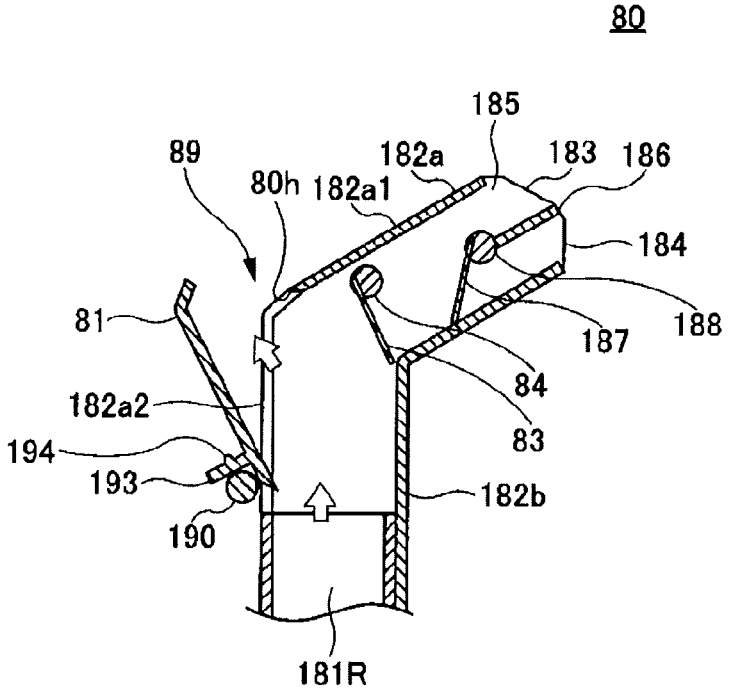
FIG. 15 is an enlarged cross-sectional view illustrating the main part of the duct of the front-end air blowing unit according to the third embodiment of the present invention (during cut-off of air).

Subsequently, the arithmetic control unit 31 controls driving of the second solenoid SL2, thereby opening the doors 81 such that the opening part 182*h* is opened (FIG. 15). Then, in STEP S15, the arithmetic control unit 31 cuts off air for separating sent from the air blowing parts 183 such that the air cannot flow toward the separating air blowing part 185.

FIG. 15 is an enlarged cross-sectional view illustrating the main part of the duct 80 during air cut-off.

The duct 80 shown in FIG. 15 is in a state in which the first shutter plate 187 opens the separating air blowing part 185 and the second shutter plate 83 blocks the air flow passage and the doors 81 are open. This state is a state in which air in the duct 80, that is, air (air for separating) sent from the air blowing fans 181 is discharged from the opening part 80*h*, and corresponds to the state of the duct 182 (FIG. 7) according to the first embodiment during air cut-off.

Subsequently, in STEP S16, in the state where the sheet P is sucked on the suction belt 133, the arithmetic control unit 31 turns on the suction belt clutch CL1, thereby rotating the suction belt 133 to start transporting the sheet P sucked on the suction belt 133.

Opening of the doors 81 in STEP S15 and sheet transport start in STEP S16 may be performed at the same time or in reverse order.

Subsequently, in STEP S17, the arithmetic control unit 31 closes the doors 81 (thereby closing the opening part 80*h*) to release cut-off of air by the second shutter plate 83.

Subsequently, in STEP S18, the arithmetic control unit 31 closes the doors 191, thereby closing the opening part 182*h*.

Thereafter, similarly in the first embodiment, on the basis of the detection results of the delivery sensor 25 and the transport sensor 27, the arithmetic control unit 31 controls the suction belt clutch CL1 and the transport roller clutch CL2, thereby transporting the sheet.

Subsequently, in STEP S19, the arithmetic control unit 31 determines whether there is a sheet necessary to be fed, on the basis of the print job. In a case where there is a sheet necessary to be fed ("YES" in STEP S19), the arithmetic control unit 31 proceeds to STEP S11, and switches the first shutter plate 187 such that the floating air blowing part 184 is opened and air for floating is blown.

As described above, the third embodiment performs the process of blocking the flow passage in the duct 80 by second shutter plate 83 and the process of blocking the flow passage by the second shutter plate 83, in parallel, such that the doors 81 open the opening part 80*h* of the duct 80. Therefore, after the second shutter plate 83 blocks the flow passage, air in the duct 80 is discharged.

Similarly to the first embodiment, the third embodiment configured as described above stops blowing air to the sheets P such that a sheet P is separated, and removes air from the duct 80 through the opening part 80*h* such that the pressure in the duct 80 decreases, and then blows air again. Therefore, during re-blowing, a desired volume of air is obtained. Therefore, it is possible to appropriately re-blow air without causing sheets to run violently (be deformed) or be blown away.

In the above-described third embodiment, in a period from when a sheet floats by blowing air from the air blowing outlet toward the sheet bundle to when the suction transport unit 13 starts transporting the sheet, the flow passage of the duct 80 is blocked by the second shutter plate 83.

Also, in the third embodiment, in a period from when the suction transport unit 13 starts transporting the sheet to when the next sheet is floated by blowing air from the air blowing outlet toward the sheet bundle, the doors 81 open the opening part 80*h* such that air in the duct 80 is discharged.

Also, in the third embodiment, in a period from when the doors 81 open the opening part 80*h* to when the next sheet is floated by blowing air from the air blowing outlet toward the sheet bundle, blocking of the flow passage by the second shutter plate 83 is released.

Also, in the third embodiment, in a period from when blocking of the flow passage by the second shutter plate 83 is released to when the next sheet is floated by blowing air from the air blowing outlet toward the sheet bundle, the doors 81 close the opening part 80*h*.

4. Fourth Embodiment

In the first to third embodiments, the doors are configured as a rotating mechanism; however, they may be configured as a sliding mechanism.

Figure 16:
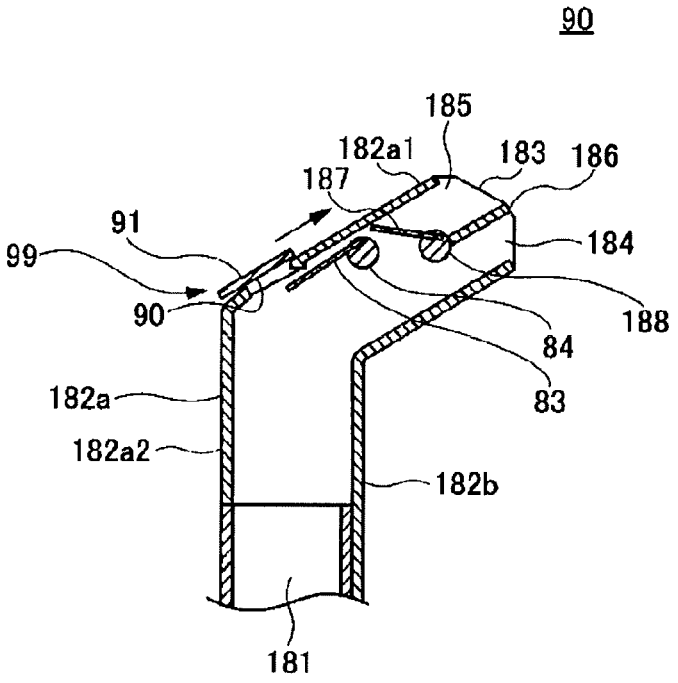
FIG. 16 is an enlarged cross-sectional view illustrating a main part of a duct of a front-end air blowing unit according to a fourth embodiment of the present invention.

FIG. 16 is an enlarged cross-sectional view illustrating a main part of a duct of a front-end air blowing unit according to a fourth embodiment. With reference to FIG. 16, differences from the ducts 182 and 80 according to the first and third embodiments will be mainly described.

A duct 90 has, for example, a sliding door 91 corresponding to an opening part 90*h* of the upper wall 182*a*1 upper than a curved part 99. The sliding door 91 slides on the surface of the upper wall 182*a*1 under the control of the control unit 30, thereby opening or closing the opening part 90*h*. The opening/closing timings of the sliding door 91 are the same as those of the doors 81 according to the third embodiment. A mechanism for sliding the sliding door 91 can be implemented by known technologies, and thus will not be described.

The fourth embodiment configured as described above achieves the same effects as those of the third embodiment.

5. Fifth Embodiment

Figure 17:
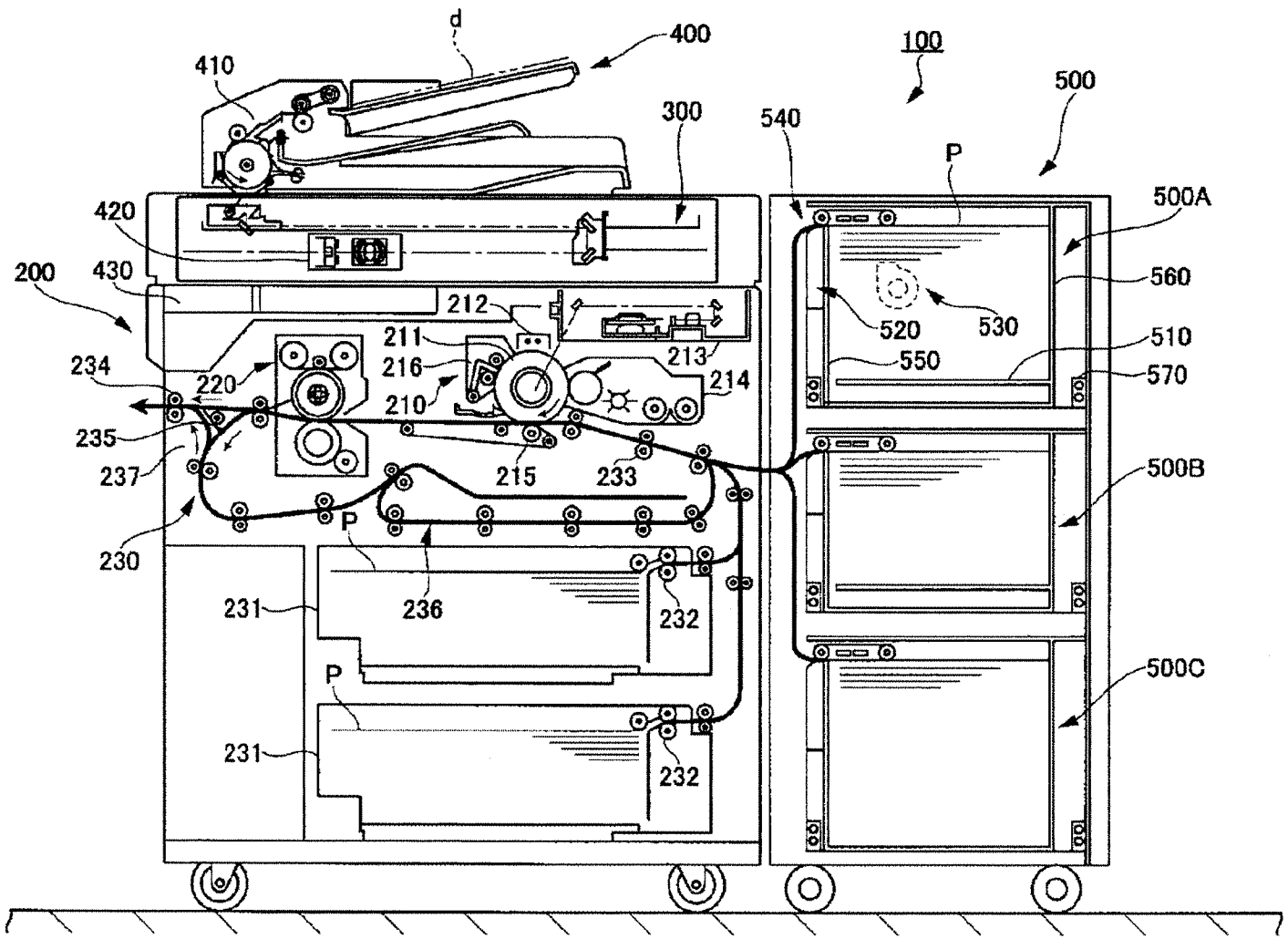
FIG. 17 is a view illustrating the overall configuration of an example of an image forming apparatus using a sheet feeding device according to a fifth embodiment of the present invention.

FIG. 17 is a view illustrating the overall configuration of an example of an image forming apparatus using a sheet feeding device according to a fifth embodiment.

A sheet feeding device 10 according to the present embodiment can be preferably used as a sheet feeding device for feeding sheets to an image processing device. As examples of an image forming apparatus using the sheet feeding device 10 according to the present embodiment, copy machines, printer devices, facsimile machines, printing machines, multi-function apparatuses, and the like can be taken. Hereinafter, a case where an image forming apparatus using the sheet feeding device 10 according to the present embodiment (an image forming apparatus of the present invention) is a copy machine will be described as an example.

FIG. 17 is a view illustrating the overall configuration of an example of the image forming apparatus using the sheet feeding device according to the present embodiment. As shown in FIG. 17, an image forming apparatus 100 according to the present example is configured to have an image forming apparatus body 200, an image reading device 300, an automatic document feeder 400, and a sheet feeding device 500.

The image forming apparatus body 200 includes an image forming unit 210, a fixing unit 220, and a sheet transporting unit 230. In the image forming apparatus body 200, the image forming unit 210 includes a photoconductor 211, a charging unit 212, an exposing unit 213, a developing unit 214, a transferring unit 215, a cleaning unit 216, and so on.

The photoconductor 211 is an image carrier, and is driven to rotate by a driving source (not shown in the drawings). The charging unit 212 uniformly charges the surface of the photoconductor 211 by applying electric charge to the photoconductor 211. The exposing unit 213 exposes the surface of the photoconductor 211 on the basis of image data read from a document d and the like, thereby forming an electrostatic latent image on the photoconductor 211.

The developing unit 214 develops the electrostatic latent image formed on the photoconductor 211, with a two-component developer composed of toner and carrier, thereby forming a toner image. The transferring unit 215 transfers the toner image formed on the photoconductor 211, onto a sheet P transported by the sheet transporting unit 230. The cleaning unit 216 removes the toner remaining on the photoconductor 211, that is, the cleaning unit cleans the surface of the photoconductor 211.

The sheet transporting unit 230 includes sheet cassettes 231, a first sheet feeding unit 232, a second sheet feeding unit 233, a discharging unit 234, a transport path switching unit 235, a cycling sheet re-feeding unit 236, and a sheet inverting/discharging unit 237.

The document d mounted on a platen of the automatic document feeder 400 is transported to the image reading device 300 by a sheet feeding unit 410. Images on one side or both sides of the document d transported to the image reading device 300 are exposed by an optical system, and are read by an image sensor 420. An analog signal obtained by photoelectric conversion of the image sensor 420 is subjected to various processing such as analog processing, A/D conversion, shading correction, and image compression in an image processing unit 430. Then, the image signal subjected to various signal processing is transmitted from the image processing unit 430 to the exposing unit 213.

In the image forming unit 210, the surface of the photoconductor 211 is charged by the charging unit 212, and is irradiated with laser light from the exposing unit 213, such that an electrostatic latent image is formed, and is developed by the developing unit 214 such that a toner image is formed. Subsequently, a sheet P stored in a sheet cassette 231 is transported by the first sheet feeding unit 232. The sheet P is transported in sync with the toner image by the second sheet feeding unit 233 composed of resist rollers. Thereafter, the toner image is transferred onto the sheet P, and then is fixed by the fixing unit 220.

After the fixing, the sheet P is discharged to the outside of the image forming apparatus body 200 by the discharging unit 234. Meanwhile, after the transferring, the toner remaining on the photoconductor 211 is removed by the cleaning unit 216. Also, during two-sided copying, after an image is formed on a first surface of a sheet P, the sheet is transported to the cycling sheet re-feeding unit 236 and is inverted. Then, an image is formed on the second surface of the sheet in the image forming unit 210, and the sheet is discharged to the outside of the image forming apparatus body 200 by the discharging unit 234. During inverted sheet discharge, a sheet P departing the normal discharge path is inverted in the sheet inverting/discharging unit 237, and then is discharged to the outside of the image forming apparatus body 200 by the discharging unit 234.

The sheet feeding device 500 is an air-suction sheet feeding type sheet feeding device connected to the image forming apparatus body 200 and configured to separate sheets P one by one by blowing air and feed each sheet to the image forming apparatus body 200.

The sheet feeding device 500 according to the present example is, for example, a large-capacity sheet feeding device composed of three sheet feeding units 500A, 500B, and 500C having three sheet feed trays and capable of holding a large amount of sheets P. The three sheet feeding units 500A, 500B, and 500C basically have the same configuration. Therefore, here, the configuration of the uppermost sheet feeding unit 500A will be described in brief.

The sheet feeding unit 500A is configured to include a sheet feed tray 510, a front-end air blowing unit 520, lateral air blowing units 530, a suction transport unit 540, a front-end restricting member 550, a rear-end restricting member 560, a guide rail 570, and so on. Also, the sheet feed tray 510 is configured to be drawn along the guide rail 570 from the sheet feeding device 500.

In the image forming apparatus 100 having the above-described configuration, as the sheet feeding device 500, more specifically, as each sheet feeding unit 500A, 500B, or 500C of the sheet feeding device 500, the sheet feeding device 10 or 10A according to the above-described embodiments can be used. In the correspondence relation of main components of FIG. 17, FIG. 1, and FIG. 2, the front-end air blowing unit 520 corresponds to the front-end air blowing unit 18, and the lateral air blowing units 530 correspond to the lateral air blowing units 20L and 20R, and the suction transport unit 540 corresponds to the suction transport unit 13.

As described above, in the image forming apparatus 100 such as a copy machine having a sheet feeding device, as the sheet feeding device, the sheet feeding device 10 or 10A of the above-described embodiments is used. Therefore, it is possible to accurately transport sheets P to the image forming apparatus body 200 without degrading the sheet transporting performance. Therefore, in the image forming apparatus 100, it is possible to stably perform a printing process.

Also, here, as an example of the image forming apparatus 100 using the sheet feeding device 10 according to the above-described embodiment, a copy machine has been taken; however, the present invention is not limited thereto. In other words, the present invention can be applied to every image forming apparatus having an air-suction sheet feeding type sheet feeding device having an air blowing mechanism, such as printer devices, facsimile machines, printing machines, and multi-function apparatuses.

Also, even if the sheet feeding device 10 is applied to the sheet cassettes 231 of the image forming apparatus body 200, it is possible to achieve the same effects.

6. Others

In the above-described embodiment, an example in which the present invention is applied to an image forming apparatus for forming monochrome images has been described. However, the present invention can be applied to image forming apparatuses for forming color images.

Also, in the above-described embodiments, the suction transport unit 13 has one suction belt 133; however, two or more suction belts may be provided.

Also, in the above-described embodiments, the floating air blowing part 184 and the separating air blowing part 185 of the duct 182, 60, 80, or 90 may be integrally configured such that it is unnecessary to perform switching between air for floating and air for separating. In other words, a function of blowing an air for separating may be omitted.

Also, in the above-described embodiments, as an example of the system for driving the suction belt 133 of the suction transport unit 13 and the individual rollers, the motors (DC motors) and clutch systems have been taken. However, other driving systems such as stepping motors can be used.

Further, it is apparent that the present invention is not limited to the above-described embodiments, and various applications and modifications can be made without departing from the scope of the present invention described in claims.

For example, in the above-mentioned embodiments, in order to facilitate understanding of the present invention described in detail, the configurations of the apparatuses and the systems have been described in detail and specifically; however, the present invention is not restricted to a configuration including all the components described above. Further, a part of the configuration of an embodiment can be replaced with the configuration of another embodiment. Also, the configuration of a certain embodiment can be added to the configuration of another embodiment. Moreover, with respect to a part of the configuration of each embodiment, it is possible to add other components, delete some components, or replace some components with other components.

Also, some or all of the configurations, the functions, the processing units, the processing means, and so on described above can be realized with hardware, for example, by designing an integrated circuit. Further, the configurations, the functions, and so on described above can be realized with software by interpreting and executing programs for implementing them in a processor realizing the respective functions. The information such as the programs, tables and files for realizing the individual functions can be stored in storage devices such as memories, hard disks, and SSDs (Solid State Drives), or in memory media such as IC cards, SD cards, and DVDs.

Also, the drawings show only control lines and information lines considered as being necessary for description, not all of control lines and information lines necessarily required for products. In actual application, it can be considered that almost all the components are mutually coupled.

Also, in this specification, processing steps describing chronological processing include not only processing which is performed chronologically in a described order but also processing which is not necessarily performed chronologically and is performed in parallel or individually (for example, parallel processing or processing using objects).

Other objects, configurations, and effects will be clear by the following description of embodiments.

Although embodiments of the present invention have been described and illustrated in detail, it is clearly understood that the same is by way of illustration and example only and not limitation, the scope of the present invention should be interpreted by terms of the appended claims.

What is claimed is:

1. A sheet feeding device comprising:

a sheet storage unit configured to store sheets;

an air blowing unit configured to blow air;

a duct configured as a flow passage to an air blowing outlet for blowing air sent from the air blowing unit toward the front end of an upper part of a sheet bundle stored in the sheet storage unit;

a suction transport unit configured to suck a sheet floating from the sheet bundle upward and transport the sheet;

a shutter member configured to block the flow passage in the duct; and an openable/closeable member configured to open an opening part of the duct, such that air staying in the duct by blocking the flow passage by the shutter member is discharged from the opening part in a direction away from the sheet storage unit.

2. The sheet feeding device according to claim 1, wherein: the openable/closeable member forms a part of the wall of the duct.

3. The sheet feeding device according to claim 2, wherein: the shutter member and the openable/closeable member are integrally configured.

4. The sheet feeding device according to claim 2, wherein: a part of the duct is a curved part, and the shape of the openable/closeable member corresponds to the shape of the curved part.

5. The sheet feeding device according to claim 4, wherein: the openable/closeable member is disposed in the traveling direction of air which is sent from the air blowing unit.

6. The sheet feeding device according to claim 2, wherein: the openable/closeable member rotates on a rotating shaft disposed along a direction perpendicular to the transport direction of the sheet, such that the opening part is opened.

7. A sheet feeding method of a sheet feeding device which includes a sheet storage unit configured to store sheets, an air blowing unit configured to blow air, a duct configured as a flow passage to an air blowing outlet for blowing air sent from the air blowing unit toward the front end of an upper part of a sheet bundle stored in the sheet storage unit, a suction transport unit configured to suck a sheet stored in the sheet storage unit upward and transport the sheet, a shutter member configured to block the flow passage in the duct, and an openable/closeable member configured to open and close an opening part of the duct, comprising:

blocking the flow passage in the duct by the shutter member; and while the shutter member blocks the flow passage, driving the openable/closeable member so as to open the opening part of the duct such that air staying in the duct after the shutter member blocks the flow passage is discharged from the opening part in a direction away from the sheet storage unit.

8. The sheet feeding method according to claim 7, wherein:

in a period from when the sheet floats by blowing the air from the air blowing outlet toward the sheet bundle to when the suction transport unit starts transporting the sheet, the shutter member blocks the flow passage of the duct.

9. The sheet feeding method according to claim 7, wherein:

in a period from when the suction transport unit starts transporting the sheet to when the next sheet is floated by blowing the air from the air blowing outlet toward the sheet bundle, the openable/closeable member opens the opening part, such that air in the duct is discharged.

10. The sheet feeding method according to claim 7, wherein:

in a period from when the openable/closeable member opens the opening part to when the next sheet is floated by blowing the air from the air blowing outlet toward the sheet bundle, blocking of the flow passage by the shutter member is released.

11. The sheet feeding method according to claim 7, wherein:

in a period from when blocking of the flow passage by the shutter member is released to when the next sheet is floated by blowing the air from the air blowing outlet toward the sheet bundle, the openable/closeable member closes the opening part.

* * * * *